US008122657B2

(12) United States Patent
Stein

(10) Patent No.: US 8,122,657 B2
(45) Date of Patent: Feb. 28, 2012

(54) METAL "LOG" BUILDINGS WITH RIGID INSULATION

(76) Inventor: Alejandro Stein, Crans-pres-Celigny (CH)

( * ) Notice: Subject to any disclaimer, the term of this patent is extended or adjusted under 35 U.S.C. 154(b) by 0 days.

(21) Appl. No.: 12/218,913

(22) Filed: Jul. 18, 2008

(65) Prior Publication Data

US 2010/0011686 A1 Jan. 21, 2010

(51) Int. Cl.
*E04B 2/58* (2006.01)
*E04B 2/70* (2006.01)

(52) U.S. Cl. ..... 52/233; 52/561; 52/745.1

(58) Field of Classification Search ..... 52/233, 52/561, 582.1, 741.13, 745.1, 747.1
See application file for complete search history.

(56) References Cited

U.S. PATENT DOCUMENTS

| | | | | |
|---|---|---|---|---|
| 3,378,969 | A * | 4/1968 | Larger | 52/223.7 |
| 4,191,001 | A * | 3/1980 | L'Heureux | 52/742.13 |
| 4,619,089 | A | 10/1986 | Stein | |
| 5,282,343 | A | 2/1994 | Stein | |
| 5,485,703 | A * | 1/1996 | Nordahl | 52/562 |
| 6,295,778 | B1 * | 10/2001 | Burt | 52/592.6 |
| 2006/0272264 | A1 | 12/2006 | Parker | |

FOREIGN PATENT DOCUMENTS

| | | | |
|---|---|---|---|
| EP | 1094166 | A2 | 4/2001 |
| WO | 2008/012375 | A1 | 8/2006 |

* cited by examiner

*Primary Examiner* — Phi Dieu Tran A
(74) *Attorney, Agent, or Firm* — Donald S. Dowden

(57) ABSTRACT

Hollow metal "logs" each extending usually horizontally are arranged in adjacent, parallel, spaced-apart relation to form, or be part of, a wall or roof. Rigid insulating members are inserted between the logs. Each insulating member is shaped to fit around a log on either side of the insulating member. Each insulating member has a pair of outer faces respectively on either side of the wall or roof and lying substantially in respective planes parallel to the axes of the logs. The insulating members abut one another and collectively surround the logs and insulate the wall or roof.

9 Claims, 4 Drawing Sheets

METAL "LOG" BUILDINGS WITH RIGID INSULATION

BACKGROUND OF THE INVENTION

1. Field of the Invention

This invention relates to log wall and building structures, and more particularly to a novel and highly effective combination of elements that greatly improves the thermal insulation and other properties of such buildings, especially those made of hollow metal "logs," while reducing their cost.

2. Description of the Prior Art

Log buildings have a long history, as indicated in applicant's co-pending U.S. patent application Ser. No. 12/157,051, filed Jun. 6, 2008. That application and the applicant's prior U.S. Pat. Nos. 4,619,089 and 5,282,343 are incorporated herein by reference.

Traditional log buildings made of wood have drawbacks, including the sheer weight and bulk of the logs and the consequent expense and difficulty of shipping and handling them; their lack of uniformity, even when trimmed to size; the inevitable waste, and, in many locales, the scarcity of wood. But because log structures have a certain aesthetic appeal, wood logs are still used to some extent to construct houses, sheds and other low-rise buildings including apartments, schools, lodges and commercial buildings. Usually, however, wooden structures today are not made of logs but are framed with sills, joists, studs, rafters, and ridgepoles and finished with interior and exterior sheathing.

As applicant's co-pending application identified above explains, the construction of log buildings has undergone considerable evolution. Whereas it traditionally employed solid wood logs, it now may employ hollow metallic "logs" that have undeniable merits, including savings in the cost and volume of materials, shipping and labor, lack of dependence on skilled labor, speed of construction, adaptability to use in remote locations, and resistance to damage by fire and termites. Indeed, experts predict that hollow metal structures called "metalogs" by analogy to conventional wood logs could become a preferred way of construction in much of the world for low-rise buildings.

The '089 and '343 patents identified above and corresponding patents in other countries disclose the best prior examples of metalog construction. Buildings following their teachings have been erected in many parts of the world and are finding wide and growing acceptance. They are suitable for all markets in view of their properties noted above, plus their ready compliance with building codes, their flexible floor plans, and their aesthetics, which are adaptable to local styles. Government authorities and private builders in various countries have endorsed them because of their low cost and the rapidity with which they can be erected to replace buildings that are substandard, or have been damaged or destroyed by fire, earthquake, insect infestation, etc.

Air is a poor conductor of heat and in the absence of convection a good insulator. One reason for the growing popularity of hollow-metal-log construction is that metalogs, by virtue of the air they enclose, have inherent insulating properties, even if made of a material such as aluminum or steel that readily conducts heat. The inherent insulating properties of hollow metal logs amply justify their use in constructing buildings in balmy climates. In some climates, however, their inherent insulating properties may be insufficient, since the metal, even though thin and thus having relatively modest mass, conducts heat from the warmer side of a wall formed by the logs to the cooler side. Even if the logs are made of plastic or another material having good insulating properties, conventional hollow log structures may not be suited to extreme climates.

In cold climates, the conduction of heat through the material of which the logs of an exterior wall are formed and the radiation of the heat into the surroundings cools the material and therefore the air within the building near the wall. This increases the density of that air and causes an uncomfortable downdraft of cold air near the wall, and an uncomfortable flow of cold air near the floor and towards the center of the room of which the wall forms a boundary. Below a certain temperature that depends on the relative humidity of the air within the room, condensation forms on the wall, giving the room a clammy feeling. And the constant escape of heat to the environment increases the expense of maintaining a set temperature within the building. The high and rising price of heating oil and other fuels intensifies the need to find a remedy.

In hot climates, the flow of heat is often in the other direction. Solar radiation heats the outer side of the logs, and the material of which the logs are made conducts the heat to the interior of the building, raising the temperature and causing discomfort to the people there. Even after sunset, it is likely in the absence of air-conditioning to be noticeably warmer inside than outside the building. And the operating cost of air-conditioning is proportional to the ease with which heat flows from the outside to the inside of the building.

Thermal insulation is of course known as a means of promoting human comfort in structures of all types in both cold and hot climates. An installation of thermal insulation in a conventional wood-frame structure involves blowing insulating material into the spaces between studs, joists or rafters, and/or positioning batts or mats of insulation by hand in those spaces. As conventionally practiced, both methods have a number of drawbacks.

In either case, the thickness of the insulation is often determined by the width of the studs, joists or rafters, rather than by the required R-value (apparent thermal conductivity) of the insulation.

Batt and mat insulation has the additional drawback that it is likely to leave small gaps between the batts or mats and adjoining support structures, thereby providing passages for the escape of heat. Since the adjoining support structures such as two-by-four studs are normally at intervals of 16 inches in the US and at similar intervals in other countries, there may be many such leakage passages in the span of a typical wall or roof.

Blown insulation poses a significant health risk to the workers who do the installation. Inevitably, despite wearing (usually nowadays, though not formerly) protective masks, they inhale small airborne fibers of asbestos, rock wool, fiberglass or other insulating material, which can cause mesothelioma, chronic obstructive pulmonary disease and other serious medical conditions.

Neither blown insulation nor manually placed batts or mats have been used in hollow-metal-log construction. Insulation blown into hollow metal logs would have indeed a benefit, but the net benefit would be modest, because blown insulation displaces air—itself a good insulator—and does little to retard heat transfer through spaces between logs by convection or through the metal by conduction. And neither blown insulation nor batts/mats can be deployed in separate channels exterior to hollow metal logs without the provision of elaborate auxiliary structure for their support or, at least, their protection from weather, etc.

Applicant's '343 patent identified above discloses in FIGS. 8*a-d* and associated text the best methods known heretofore of applying thermal insulation to metal logs. They involve winding a mat through gaps between logs, covering the logs with wide mats overlapping like shingles on one or both sides of the logs, or wrapping mats around the logs to form sleeves. None of these methods provides structural support for a wall or roof or provides weather resistance, and all require additional interior and exterior sheathing.

In conventional metal log construction of, say, a rectangular wall, hollow metalogs, each extending usually horizontally, are arranged in adjacent, parallel, superposed relation. The logs are supported at their ends, typically though not necessarily in slightly spaced-apart relation, by end connectors each having a connecting portion inserted into a log and a stackable portion. The stackable portions are stacked one above another. Alternatively, the ends of the logs are stacked in vertical retaining grooves formed in stanchions, as shown in FIGS. 12 and 13 of the applicant's '089 patent mentioned above.

In conventional practice, in order to prevent infiltration of air and water, it is necessary to install at least exterior sheathing, and builders usually wish to install interior sheathing as well.

OBJECTS AND SUMMARY OF THE INVENTION

An object of the invention is to improve further the construction methods and resulting buildings disclosed in the patents mentioned above and in other prior art. In particular, an object of the invention is to simplify and speed up the construction of metalog buildings while lowering their cost and considerably improving their thermal insulation without increasing the thickness of exterior walls and roofs on a proportional basis.

The invention attains these and other objects through a novel combination of elements, including a plurality of log-shaped members each having an axis extending usually horizontally. In cross section, the log-shaped members are circular or oval or have another suitable shape. They are arranged in adjacent, parallel, spaced-apart relation to form, or be part of, a wall or roof. Rigid insulating members (insulating blocks) are inserted between the log-shaped members, each insulating member being shaped to fit around a log-shaped member on either side of the insulating member. Each rigid insulating member or block has a pair of outer faces respectively on either side of the wall or roof and lying substantially in respective planes parallel to the axes of the log-shaped members. The insulating members abut one another and collectively surround the log-shaped members and insulate the wall or roof.

The rigid insulating members/blocks are made of polystyrene, polyurethane, extra-light cement or concrete (for example, an autoclaved aerated concrete such as Ytong®) or any alternative thereto (including a mixture of different materials) that has sufficient rigidity and provides sufficient thermal insulation. End connectors or spacers separate the logs in a vertical direction by whatever predetermined distance provides the desired thickness of insulation between logs. In addition, the blocks have a predetermined thickness in the inside-to-outside direction. An assembly in accordance with the invention thus easily gives the installation the required R-value.

The insulating blocks are arranged in courses, and their faces are substantially rectangular and of equal size. The insulating members of one course are laterally offset from the insulating members of an adjacent course a distance substantially equal to half the length of the faces in a direction parallel to the axes of the log-shaped members.

The insulating members not only impede the flow of heat between the interior and exterior of a building of which the wall forms a part but also in some embodiments of the invention obviate the use of crisscross bracing (X-bracing) otherwise required to stabilize the walls of a conventional metal log building. The insulating members moreover serve in some embodiments as exterior and/or interior sheathing, obviating the provision of additional sheathing.

Instead of sheathing opposite sides of a wall with separate panels, as in the prior art, the invention provides components shaped in a way that insulates and protects the logs on all their sides, including the spaces between logs. Moreover, the same components create continuous vertical surfaces on both sides of the wall.

When installed in the usual manner in horizontal courses, the insulating blocks are preferably longer in the horizontal than in the vertical direction. Their dimension in the vertical direction is equal to the vertical center-to-center spacing between the metal logs. The horizontal dimension may be a small multiple, say 1.5 to 5.0, of the vertical dimension. In alternate courses, the horizontal dimension of end blocks can be reduced by half so that the junctions between blocks are staggered, as in a conventional brick wall. In all courses, the horizontal dimensions of blocks can be adjusted to fit at one end of a wall (as at a corner of a building) or section thereof (as at a doorjamb), and if need be at both ends.

These are guidelines; it is within the scope of the invention to alter the shape of the blocks to suit the purposes of the architect or designer.

The shape of the outer surfaces of the blocks, being decoupled from the shape of the logs, is typically substantially planar but can take any form the architect or building designer wishes to give it. In particular, a block can have a lip at the bottom on its side intended for the outer side of an exterior wall. The lip overhangs the block below to shed rain. This is a useful feature where the wall has no additional exterior cladding or sheathing, as where the blocks have, say, a stucco finish. Additional sheathing is, however, always optional, and if used obviates a rain-shedding lip. Such a lip is also unnecessary on the side of an insulating block intended for the inner side of an exterior wall, on either side of an interior wall (which ordinarily is not insulated in any event) and, since a separate roofing material will be provided, on either side of an insulating block intended for a roof.

The structure described above is repeated as necessary with the rigid insulating blocks arranged in brick-like fashion to form a complete wall or roof, the latter being covered with a rain-shedding material and the former optionally with interior and/or exterior sheathing. Ultimately, an entire edifice is constructed in accordance with the invention, with suitable provision for doors, windows, floors, chimneys, vents, electrical service, supply and waste plumbing, etc. The insulating members may give a completed wall the appearance of brick, stucco, or clapboard, depending on the materials employed, whether the blocks are provided with a rain-shedding lip, and other design features.

BRIEF DESCRIPTION OF THE DRAWINGS

A better understanding of the objects, features and advantages of the invention can be gained from the following detailed description of the preferred embodiments thereof, in conjunction with the appended figures of the drawings, wherein.

DETAILED DESCRIPTION OF PREFERRED EMBODIMENTS OF THE INVENTION

Figure 1:
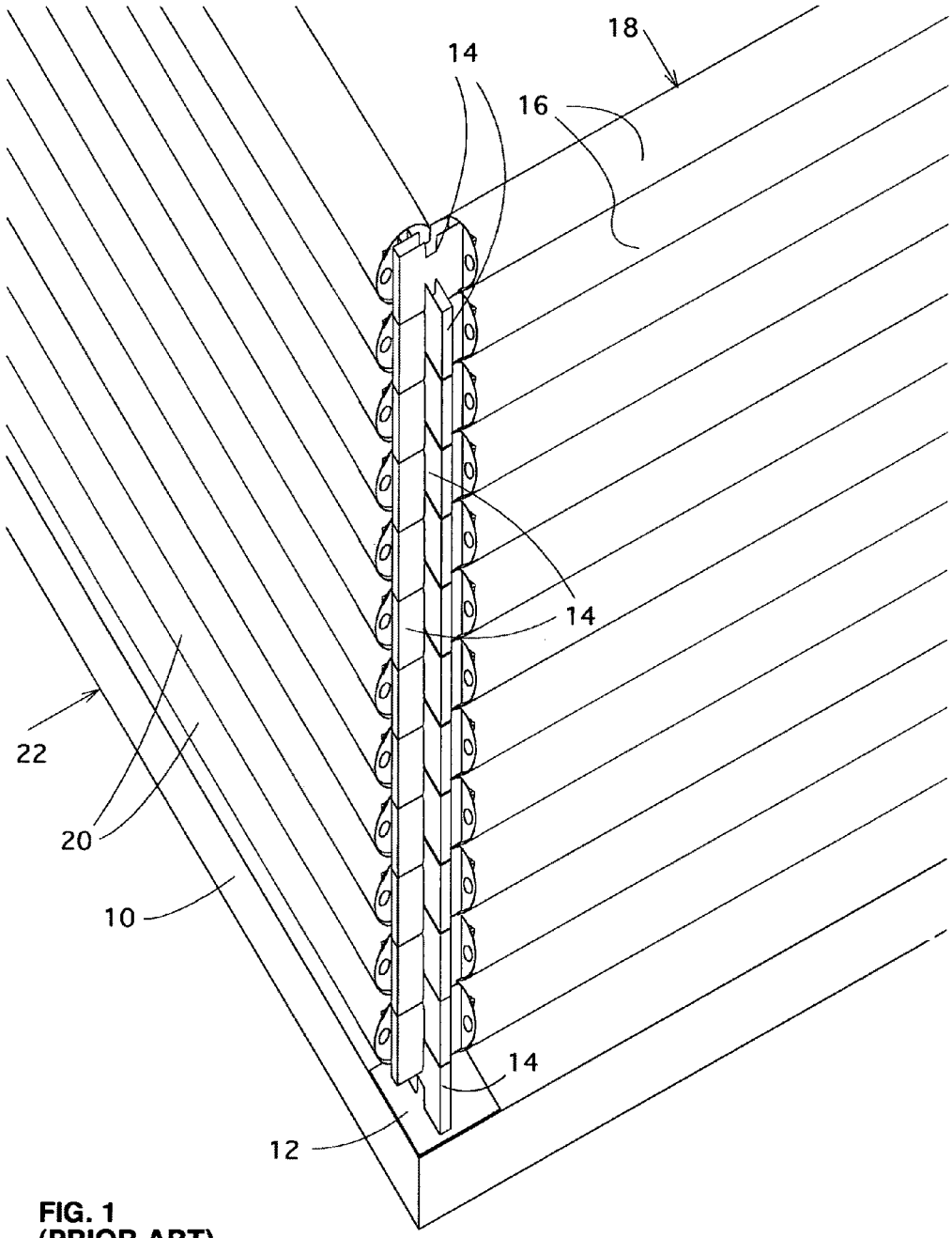
FIG. 1 (PRIOR ART)
FIG. 1 is a perspective view of a corner of a conventional structure made of hollow metal logs, showing end connectors that fit within the logs, the end connectors being stacked one on top of another and the logs being supported by the end connectors, possibly though not necessarily in spaced-apart relation, to form two walls that intersect at a right angle.

The prior art shown in FIG. 1 and described in applicant's co-pending application identified above includes a slab 10 that supports an anchor plate 12 upon which are stacked end connectors 14. The end connectors 14 are alternately inserted into hollow metal logs 16 forming part of a first wall 18 and hollow metal logs 20 forming part of a second wall 22. The slab 10 normally rests upon the ground and can be made of poured concrete or another suitable foundation material. The anchor plate 12 can be made of steel and is embedded in or otherwise firmly attached to the slab 10. The lowermost end connector 14 is secured to the anchor plate 12. Higher end connectors are stacked alternately at right angles to one another and inserted alternately into respective ends of logs 16 and 20.

It is also possible to employ a stanchion (not shown) secured to the slab 10 with or without an anchor plate 12 and formed with vertical grooves for receiving the ends of the logs 14, as disclosed for example in FIG. 12 of applicant's '089 patent mentioned above. In that case, little space—only cracks due to irregularities in the logs—is left between the logs. If similar stanchions are employed in the present invention, spacers may be placed between the end connectors to provide the separation between the logs required to accommodate the insulating members. Alternatively, the insulating blocks themselves may support the logs and provide the required separation between them.

In FIG. 1, a wind blowing from the left against the wall 22 will tend to tilt the stack of end connectors 14 to the right. (It will also tend to tilt to the right the corresponding stacks of end connectors, not shown, at the far ends of the walls 18 and 22 and at the corner of the room opposite the pictured corner.) The upper left corner of the wall 18 will tend to move closer to the lower right corner of the wall (not shown), and the upper right corner (not shown) of the wall 18 will tend to move farther away from the lower left corner. The same applies to the wall, not shown, opposite the wall 18. The converse is also true: a wind blowing against the wall 18 or the wall opposite the wall 18 will tend to distort the wall 22 and the wall opposite the wall 22.

To counter this tendency, it is recommended in conventional practice to add crisscross bracing (X-bracing) to each of the walls, running from upper left to lower right and from lower left to upper right of each wall.

In embodiments of the invention wherein the rigid insulating blocks are not bonded or otherwise firmly attached to the logs, X-bracing is recommended. In embodiments wherein the rigid insulating blocks are secured to the logs, as by staples, rivets, screws, an adhesive material, or a combination of two or more thereof, the logs and rigid insulating blocks form a continuous structural ensemble resistant to parallel horizontal forces and obviate the X-bracing.

Figure 2:
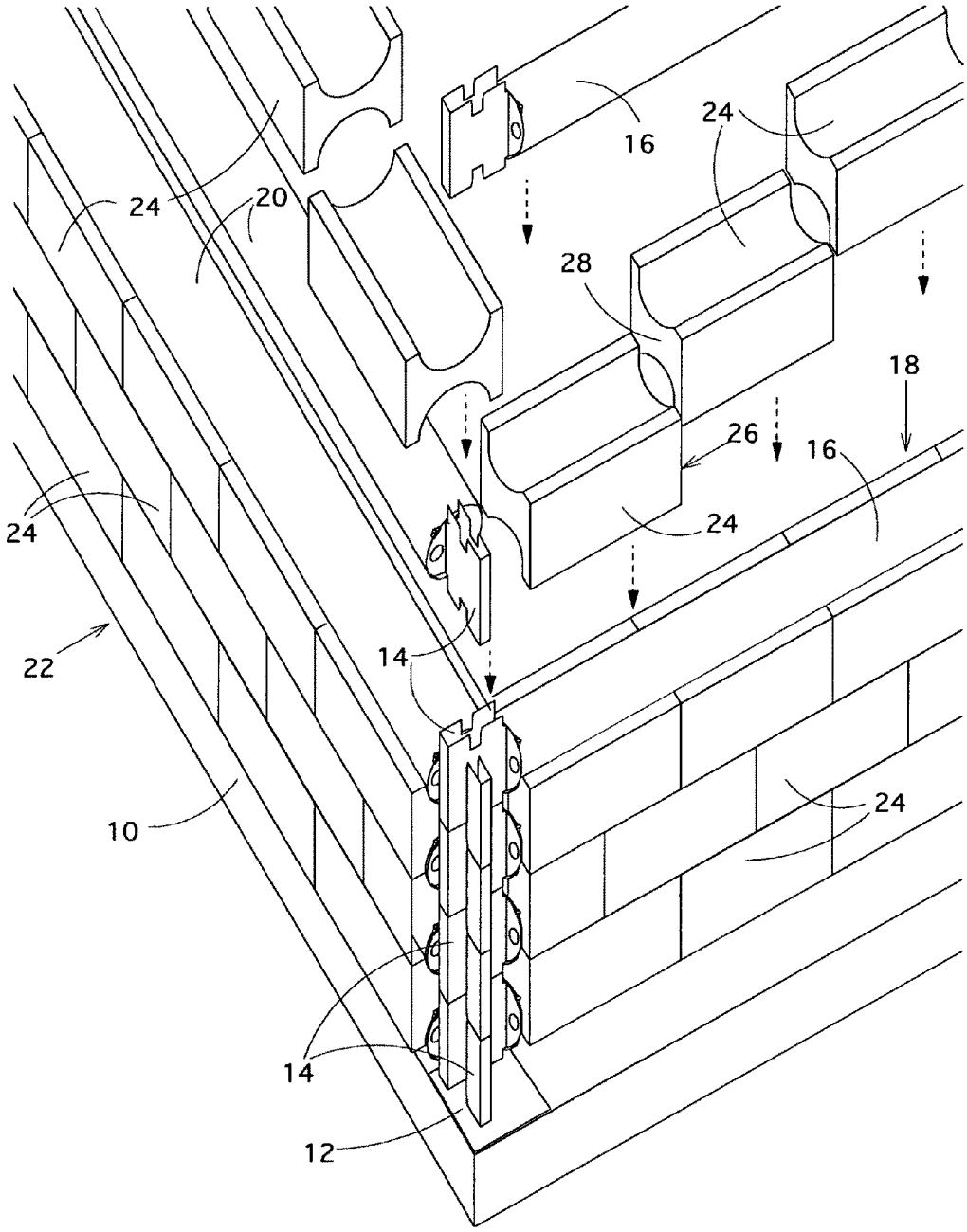
FIG. 2 is a perspective view corresponding to FIG. 1 and showing a stage in the construction of an edifice including insulating members in accordance with the invention.

FIG. 2 shows a stage in the construction of an edifice in accordance with the invention. A slab 10 supports an anchor plate 12, to which an end connector 14 is attached, as in FIG. 1. Successive end connectors 14 are stacked as indicated above. And of course the opposite ends of the logs 16 and 20 are likewise supported by end connectors or stanchions, not shown. Alternatively, as indicated above, the insulating blocks themselves may support and separate the logs.

Figure 4:
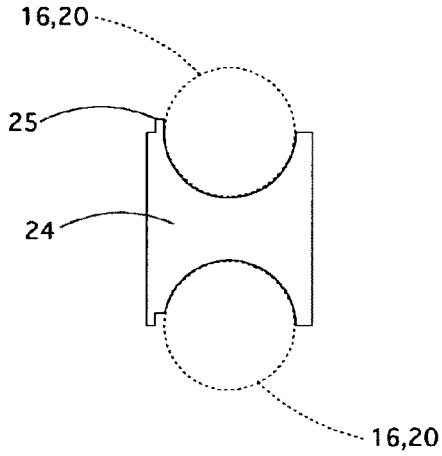
FIG. 4 is an end view of a rigid insulating member constructed in accordance with the invention and having a rain-shedding lip.
Figure 5:
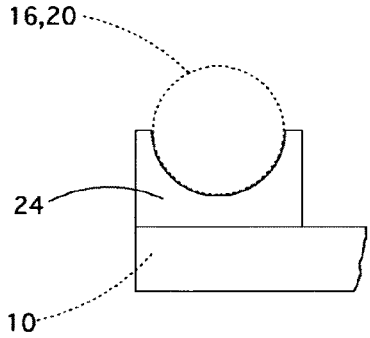
FIGS. 5 and 6 are end views of different embodiments of rigid insulating members constructed in accordance with the invention and adapted for use in the top or bottom course of a wall or roof in accordance with the invention.
Figure 6:
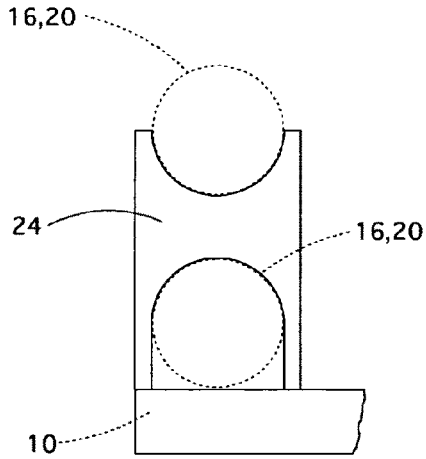

In different embodiments of the invention, insulating members 24 shaped as in FIG. 5 or 6 rest upon the slab 10 or other suitable foundation and help to form the lowermost course. In those embodiments, insulating members shaped as in FIG. 5 or 6 (inverted) may also rest upon the second-from-the-top course and help to form the uppermost course. The other insulating members are shaped as in FIG. 3 or 4 and rest upon the course immediately below. Any of the blocks can be provided with a lip corresponding to the lip 25 of FIG. 4. Alternatively, the outer faces of the blocks can be out of parallel so that the blocks are slightly wider at the bottom than at the top and the outer face of a block overhangs the outer face of the block below. In that case, the overhang should dip low enough to impede the flow of water into the space between blocks.

An edge 26 of one insulating member 24 abuts an edge 28 of a horizontally adjacent insulating member 24. The spaces between the insulators can be caulked, but caulking is often unnecessary if (1) the insulating members are offset from one course to the next as in a conventional brick wall and a suitable overhang is provided on the outer side of the insulating blocks to shed rain, or (2) additional exterior sheathing is provided.

The process illustrated in FIG. 2 is continued until the wall is completed; a similar process is employed to construct the other exterior walls and the roof of the building.

As the applicant's co-pending application identified above explains, end connectors of different heights can be used. To increase the insulation between logs, taller end connectors are required. Or, if the ends of the logs are retained in grooves in vertical stanchions, then larger spacers between the logs can be used to increase the vertical separation between the logs and provide additional space between the logs for insulation. Also, the thickness of the insulation in a direction from the inside to the outside of the structure can be varied in accordance with the required R-value. In particular, that dimension can be increased in the roof as compared to the walls of a building, to counter the tendency of heated air to rise and escape through the roof.

It is preferred in accordance with the invention to add insulating members 24 to all of the exterior walls and the roof of the edifice, but insulating members can for economy be omitted from interior walls.

Figure 3:
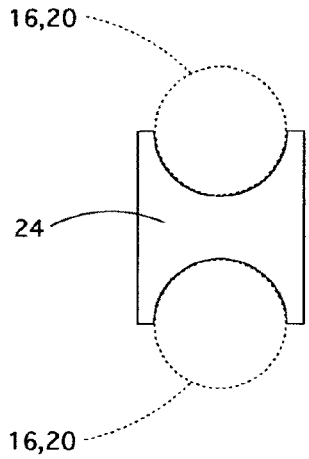
FIG. 3 is a view in end view of a rigid insulating member or block constructed in accordance with the invention.

Most of the rigid insulating blocks in a wall will be symmetrical about a horizontal midplane, as in FIG. 3, or nearly symmetrical about that plane, as in FIG. 4. A rigid block intended for the bottom course of a wall can be U-shaped, as in FIG. 5, or have an H-shape that is not symmetrical about any horizontal plane, as in FIG. 6. In FIGS. 5 and 6, the blocks 24 are shown resting on a foundation slab 10. The blocks of FIGS. 5 and 6 are also suited for the top course of a wall, inverted as described above.

Figure 7:
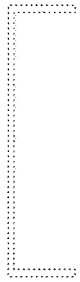
FIGS. 7-9 are fragmentary views showing fastening means that can be used in accordance with the invention to secure the rigid insulating blocks to the hollow metal logs.
Figure 8:
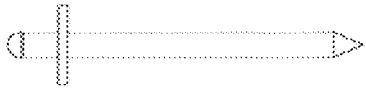
Figure 9:
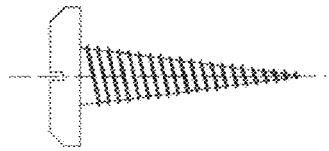
Figure 10:
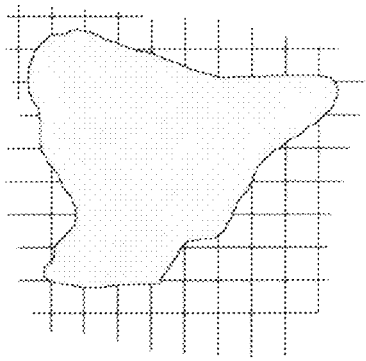
FIG. 10. Is a fragmentary view of a cementitious material that can be used as a bonding means or finishing agent in accordance with the invention.

If fitted reasonably tightly around the logs and adhered to them by suitable fastening means such as staples (FIG. 7), rivets (FIG. 8), screws (FIG. 9), a cementitious material (FIG. 10), or a combination of two or more thereof, the insulating members can make the logs of a wall or roof behave structurally as a unit well adapted to absorb parallel horizontal forces. That is, instead of working independently of one another, as in the prior art, the logs collaborate with one another as a continuous structural ensemble. Consequently, walls and roofs constructed in accordance with some embodiments of the invention dispense with X-bracing.

Moreover, the insulating members create in all embodiments continuous surfaces on both sides of the wall or roof. Depending on the type of material used to form the insulating members, they can serve either as interior and exterior cladding or sheathing or as support for stucco or similar finishing materials, as in FIG. 10. Thus, while the invention preserves the option of adding separate sheathing or for example a stucco finish, no further sheathing or finishing is required.

The savings in time and materials made possible by the omission of X-bracing and sheathing or other finishing could not have been predicted but are measurable and substantial. The illustrated embodiments of the invention are the ones preferred, but others may be envisioned.

Thus there is provided in accordance with the invention a novel and highly effective structure and method accomplishing the stated objects and others. Many other modifications within the scope of the invention will readily occur to those skilled in the art upon consideration of this disclosure. The invention encompasses all such structures and methods as fall within the scope of the appended claims.

The invention claimed is:

1. In combination, a plurality of log-shaped members each having an axis, the log-shaped members being arranged in adjacent, parallel, spaced-apart relation to form, or be part of, a wall or roof, wherein said log-shaped members are round in cross section, hollow, made of metal, and elongated along said axis, means connecting said log-shaped members together at opposite axial ends so that said connecting members and said long-shaped members form a supporting structure, and a plurality of rigid insulating members inserted between said log-shaped members, each insulating member being shaped to fit around a log-shaped member on either side of the insulating member and having a pair of outer faces respectively on either side of said wall or roof and lying substantially in respective planes substantially parallel to said axes, so that said insulating members abut one another and collectively surround said log-shaped members and insulate said wall or roof, wherein said insulating members comprise a material selected from the group consisting of polystyrene, polyurethane, extra light cement, and autoclaved aerated concrete, and a combination of two or more thereof, further comprising means securing said log-shaped members and said insulating members together to rigidify said wall or roof.

2. The combination of claim 1 wherein the insulating members are arranged in courses and the insulating members of one course are laterally offset from the insulating members of an adjacent course.

3. The combination of claim 1 wherein the insulating members are arranged in courses, said faces are substantially rectangular and of equal size, and the insulating members of one course are laterally offset from the insulating members of an adjacent course a distance substantially equal to half the length of said faces in a direction parallel to said axes.

4. The combination of claim 1 wherein the log-shaped members comprise steel.

5. The combination of claim 1 wherein the log-shaped members comprise aluminum.

6. The combination of claim 1 wherein said securing means is selected from the group consisting of staples, rivets, screws, a cementitious material and a combination of two or more thereof.

7. The combination of claim 1 comprising a finishing material applied to one or both of said outer faces.

8. The combination of claim 7 wherein said finishing material comprises stucco.

9. A method of construction comprising the steps of arranging a plurality of log-shaped members each having an axis so that the log-shaped members are in adjacent, parallel, spaced-apart relation to form, or be part of, a wall or roof, wherein said log-shaped members are round in cross section, hollow, made of a metal, and elongated along said axis, providing means connecting opposite axial ends of said long-shaped members together so that said connecting means and said log-shaped members form a supporting structure, inserting between said log-shaped members and in abutting relation to one another a plurality of rigid insulating members, shaping each insulating member to fit around a log-shaped member on either side of the insulating member, and forming a pair of outer faces respectively on either side of said wall or roof and lying substantially in respective planes parallel to said axes, so that said insulating members collectively surround said log-shaped members and insulate said wall or roof, selecting, as said rigid insulating members, blocks made of a material selected from the group consisting of polystyrene, polyurethane, extra-light cement, autoclaved aerated concrete, and a combination of two or more thereof, and providing means securing said log-shaped members and said insulating members together to rigidify said wall or roof.

* * * * *